US008308512B2

(12) United States Patent
Ritter et al.

(10) Patent No.: US 8,308,512 B2
(45) Date of Patent: Nov. 13, 2012

(54) CONNECTOR ASSEMBLY

(75) Inventors: Christopher David Ritter, Hummelstown, PA (US); Wayne Samuel Davis, Harrisburg, PA (US); Robert Neil Whiteman, Jr., Middletown, PA (US); Dharmendra Saraswat, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 18 days.

(21) Appl. No.: 13/007,944

(22) Filed: Jan. 17, 2011

(65) Prior Publication Data

US 2012/0184138 A1 Jul. 19, 2012

(51) Int. Cl.
*H01R 13/648* (2006.01)

(52) U.S. Cl. ..... 439/607.18

(58) Field of Classification Search ..... 439/79, 439/941, 947, 607.3, 607.05–607.07, 607.09, 439/607.11–607.13, 607.17–607.18, 541.5
See application file for complete search history.

(56) References Cited

U.S. PATENT DOCUMENTS

| | | | | |
|---|---|---|---|---|
| 5,735,712 | A | 4/1998 | Haas et al. | |
| 6,852,924 | B2 | 2/2005 | Lessard | |
| 7,775,802 | B2 | 8/2010 | Defibaugh et al. | |
| 7,789,676 | B2 | 9/2010 | Morgan et al. | |
| 8,002,581 | B1 * | 8/2011 | Whiteman et al. | 439/607.18 |

* cited by examiner

*Primary Examiner* — Javaid Nasri

(57) ABSTRACT

A connector assembly includes contact modules having dielectric bodies holding contacts having mating portions extending from the dielectric body. The connector assembly includes a conductive shield body holding the contact modules in a stacked configuration. The shield body provides shielding around the contact modules and the shield body has a mating end configured to be mated to a mating connector assembly. The mating end has one or more exposed surfaces between corresponding contacts. The shield body extends between selected contact modules. The connector assembly includes a conductive gasket positioned along the mating end of the shield body. The conductive gasket engages the exposed surfaces of the shield body to define a ground path between the conductive shield body and the mating connector assembly.

20 Claims, 5 Drawing Sheets

CONNECTOR ASSEMBLY

CROSS REFERENCE TO RELATED APPLICATIONS

This application relates to U.S. patent application Ser. No. 12/790,042 filed May 28, 2010, and to U.S. patent application Ser. No. 12/790,246 filed May 28, 2010, the subject matter of both of which are herein incorporated by reference in their entirety.

BACKGROUND OF THE INVENTION

The subject matter herein relates generally to shielded connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, the shielding is selectively utilized along the signal paths, where portions of the signal paths remain unshielded. Additionally, problems arise in providing shielding at the mating interface between the electrical connectors. Problems arise in providing shielding continuity between the electrical connectors.

A need remains for an electrical system that provides efficient shielding to meet particular performance demands. A need remains for an electrical system that provides a shielding interface between mated electrical connectors.

BRIEF DESCRIPTION OF THE INVENTION

In one embodiment, a connector assembly is provided that includes contact modules having dielectric bodies holding contacts having mating portions extending from the dielectric body. The connector assembly includes a conductive shield body holding the contact modules in a stacked configuration. The shield body provides shielding around the contact modules and the shield body has a mating end configured to be mated to a mating connector assembly. The mating end has one or more exposed surfaces between corresponding contacts. The shield body extends between selected contact modules. The connector assembly includes a conductive gasket positioned along the mating end of the shield body. The conductive gasket engages the exposed surfaces of the shield body to define a ground path between the conductive shield body and the mating connector assembly.

In another embodiment, a connector assembly is provided having contact modules each having a dielectric body. The dielectric body has a mating end and a mounting end. The contact modules have contacts held by the dielectric body that have contact tails and mating portions opposite the contact tails. The contact tails extend from the mounting end of the dielectric body and the mating portions extend from the mating end of the dielectric body. The connector assembly includes a conductive shield body holding the contact modules in a stacked configuration. The shield body provides shielding around the contact modules and the shield body extends between selected contact modules to provide shielding between such contact modules. The shield body has a mating end configured to be mated to a mating connector assembly. The mating end has one or more exposed surfaces between corresponding contacts. The connector assembly includes a conductive gasket positioned along the mating end of the shield body. The conductive gasket engages the exposed surfaces of the shield body and is configured to define a ground path between the conductive shield body and the mating connector assembly.

In a further embodiment, a connector system is provided that includes a header assembly, a receptacle assembly and a conductive gasket therebetween. The header assembly includes header holders and header contact modules supported by the header holders. The header holders have mating ends and support walls extending from the mating ends. The header contact modules have dielectric frames and header contacts held by the dielectric frames. The header contacts have mating portions extending from the dielectric frames. The header holders are coupled together such that the contact modules are stacked together with support walls providing shielding between header contact modules on opposite sides of the support walls. The receptacle assembly includes receptacle holders and receptacle contact modules supported by the receptacle holders that have mating ends and support walls extending from the mating ends. The receptacle contact modules have dielectric frames and receptacle contacts held by the dielectric frames that have mating portions extending from the dielectric frames that are mated with corresponding mating portions of the header contact modules. The receptacle holders are coupled together such that the contact modules are stacked together with support walls providing shielding between receptacle contact modules on opposite sides of the support walls. The conductive gasket is positioned between the mating ends of the header holders and the receptacle holders. The conductive gasket engages exposed surfaces of the header holders and the receptacle holders to define a ground path therebetween.

DETAILED DESCRIPTION OF THE INVENTION

Figure 1:
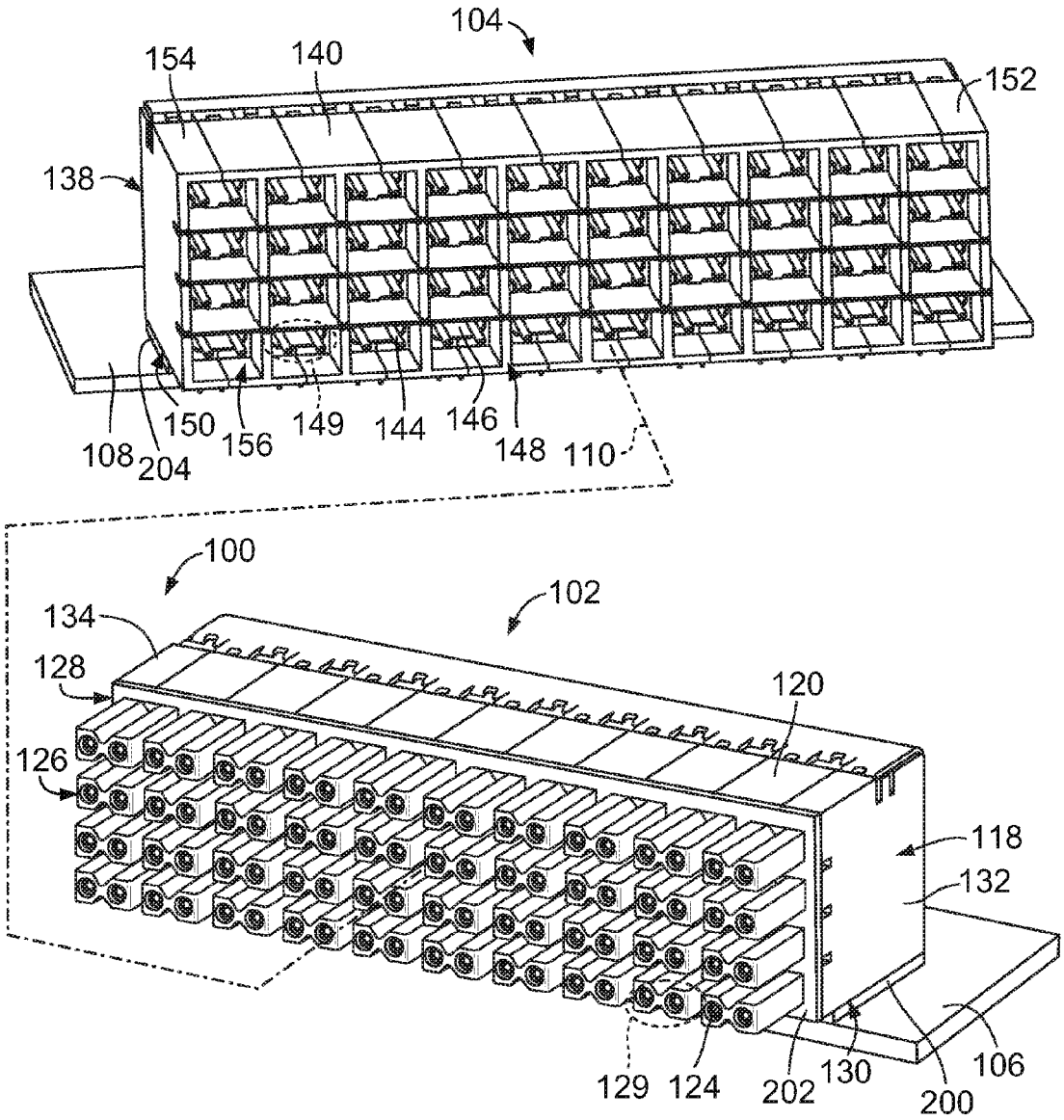
FIG. 1 is a perspective view of a connector system showing a header assembly and receptacle assembly.

FIG. 1 is a perspective view of an exemplary embodiment of a connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented coplanar to one another when the receptacle and header assemblies 102, 104 are mated. Alternative orientations of the circuit boards 106, 108 are possible in alternative embodiments. For example, the circuit boards 106, 108 may be parallel to one another, but non-coplanar with respect to one another. In some alternative embodiments, the circuit boards 106, 108 may be perpendicular to one another.

A mating axis 110 extends through the receptacle and header assemblies 102, 104. The receptacle and header assemblies 102, 104 are mated together in a direction parallel to and along the mating axis 110. In an exemplary embodiment, both the circuit boards 106, 108 extend approximately parallel to the mating axis 110.

In an exemplary embodiment, the receptacle assembly 102 is modular in design and may include any number of components that are coupled together to create the receptacle assembly 102, depending on the particular application. The receptacle assembly 102 includes a shield body 118 providing selective shielding around and within the shield body 118. The receptacle assembly 102 includes a plurality of holders 120 that support a plurality of contact modules 122 (shown in FIG. 2). The holders 120 define the shield body 118. For example, the holders 120 may be die cast, stamped and formed, metalized or otherwise made from a metal material to provide shielding for the contact modules 122 held by the holders 120.

The contact modules 122 each include a plurality of receptacle contacts 124. In the illustrated embodiment, the receptacle contacts 124 constitute socket contacts, however other types of contacts may be utilized in alternative embodiments, such as pin contacts, spring beams, tuning-fork type contacts, blade type contacts, and the like.

The holders 120 are modular in design, and any number of holders 120 may be provided and stacked together to form the shield body 118. The shield body 118 is thus defined by a plurality of individually shielded components that are coupled together to form a single body that provides electrical shielding for the receptacle contacts 124. Adding more holders 120 increases the number of contact modules 122 and thus the number of receptacle contacts 124. Alternatively, providing fewer holders 120 reduces the number of contact modules 122, and thus the number of receptacle contacts 124.

The receptacle assembly 102 includes a mating housing 126 at a mating end 128 of the shield body 118. The receptacle contacts 124 are received in the mating housing 126 and held therein for mating to the header assembly 104. The mating housing 126 is manufactured from a dielectric material and isolates the receptacle contacts 124 from one another. The mating housing 126 supports the receptacle contacts 124 and protects the receptacle contacts 124. The receptacle contacts 124 are arranged in a matrix of rows and columns. Any number of receptacle contacts 124 may be provided in the rows and columns. Optionally, the receptacle contacts 124 may be signal contacts arranged as differential pairs 129. The receptacle contacts 124 within each differential pair 129 are arranged within a common row and are part of different contact modules 122 and held in different holders 120. The holders 120 provide shielding between each differential pair 129, such as described in U.S. patent application Ser. No. 12/790,042 or U.S. patent application Ser. No. 12/790,246, the subject matter of both of which are herein incorporated by reference in their entirety. Optionally, the receptacle contacts 124 within each differential pair 129 may have the same length, and thus have a skewless design.

The receptacle assembly 102 includes a mounting end 130 that is mounted to the circuit board 106. Optionally, the mounting end 130 may be substantially perpendicular to the mating end 128, however other configurations are possible, such as having the mounting end 130 parallel to the mating end 128. The shield body 118 is arranged and exposed along the mounting end 130 for electrically grounding to the circuit board 106, such as by way of a conductive gasket 200, however other electrically commoning means or components may be used in alternative embodiments. The shield body 118 is arranged and exposed along the mating end 128 for electrically grounding to the header assembly 104, such as by way of a conductive gasket 202, however other electrically commoning means or components may be used in alternative embodiments.

The receptacle assembly 102 includes end holders 132, 134 at opposite ends of the receptacle assembly 102. The end holders 132, 134 also define a portion of the shield body 118. The end holders 132, 134 hold contact modules 122 therein.

In an exemplary embodiment, the header assembly 104 is modular in design and may include any number of components that are coupled together to create the header assembly 104, depending on the particular application. The header assembly 104 includes a shield body 138 providing selective shielding around and within the shield body 138. The header assembly 104 includes a plurality of holders 140 that support a plurality of contact modules 142 (shown in FIG. 5). The holders 140 define the shield body 138. The holders 140 have vertical walls 432 and stamped horizontal strips 434 that form part of the shield body 138. The strips 434 are separate from, and coupled to, the walls 432. Alternatively, the strips 4343 and the walls 432 may be integrally formed. The contact modules 142 each include a plurality of header contacts 144. In the illustrated embodiment, the header contacts 144 constitute pin contacts, however other types of contacts may be utilized in alternative embodiments, such as socket contacts, spring beams, tuning-fork type contacts, blade type contacts, and the like. Any number of holders 140 may be provided.

The header assembly 104 includes a plurality of mating housings 146 at a mating end 148 of the header assembly 104. The mating housings 146 are manufactured from a dielectric material and isolate the header contacts 144 from the holders 140. The header contacts 144 are received in corresponding mating housings 146 and held therein for mating to the receptacle contacts 124 of the receptacle assembly 102. Optionally, the header contacts 144 may be signal contacts arranged as differential pairs 149. The header contacts 144 within each differential pair 149 are arranged within a common row and are part of different contact modules 142 and held in different holders 140. Optionally, the header contacts 144 within each differential pair 149 may have the same length, and thus have a skewless design.

The header assembly 104 includes a mounting end 150 that is mounted to the circuit board 108. Optionally, the mounting end 150 may be substantially perpendicular to the mating end 148, however other configurations are possible, such as having the mounting end 150 parallel to the mating end 148. The shield body 138 is arranged along the mounting end 150 for electrically grounding to the circuit board 108, such as by way of a conductive gasket 204, however other electrically commoning means or components may be used in alternative embodiments. The shield body 138 is exposed at the mating end 148 for engaging the conductive gasket 202 to electrically common the shield body 138 and the shield body 118 of the receptacle assembly 102. The shield bodies 118, 138 may be electrically commoned by other components in alternative embodiments.

In an exemplary embodiment, the header assembly 104 includes end holders 152, 154 at opposite ends of the header assembly 104. The end holders 152, 154 also define a portion of the shield body 138. The end holders 152, 154 hold contact modules 142 therein. When assembled, the holders 140 and end holders 152, 154 cooperate to define a loading chamber 156 at the mating end 148. The loading chamber 156 is configured to receive a portion of the receptacle assembly 102, such as the mating housing 126. The receptacle assembly 102 is loaded into the loading chamber 156 along the mating axis 110. The receptacle contacts 124 are mated to the header contacts 144 in the loading chamber 156. In an exemplary embodiment, the connector system 100 may be reversible, wherein the receptacle assembly 102 may be received in the header assembly 104 in two different orientations (e.g. 180° from each other). The size, shape and/or orientation of the mating interfaces are such that the receptacle assembly 102 may be loaded into the loading chamber 156 right side up or upside down.

Figure 2:
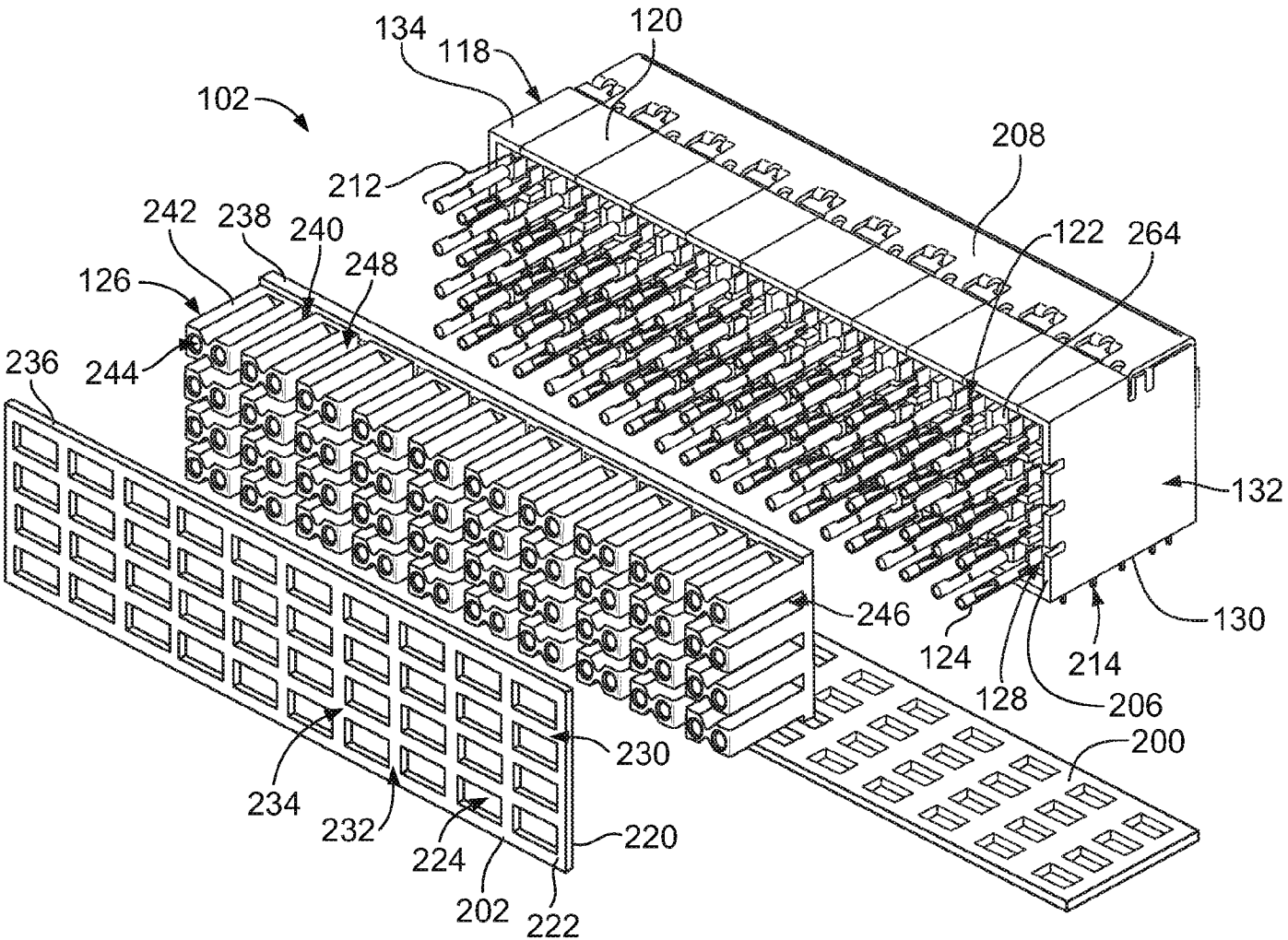
FIG. 2 is an exploded view of the receptacle assembly shown in FIG. 1.

FIG. 2 is an exploded view of the receptacle assembly 102. FIG. 2 illustrates the contact modules 122 loaded into corresponding holders 120. The mating housing 126 is poised for mounting to the holders 120. FIG. 2 also illustrates the conductive gasket 200 configured to be coupled to the mounting end 130 of the receptacle assembly 102 and the conductive gasket 202 configured to be coupled to the mating end 128.

The conductive gasket 200 defines a ground path between the shield body 118 of the receptacle assembly 102 and the circuit board 106 (shown in FIG. 1). For example, the conductive gasket 200 may engage, and be electrically connected to the holders 120 to electrically common the holders 120 to a ground circuit on the circuit board 106.

The conductive gasket 202 defines a ground path between the shield body 118 of the receptacle assembly 102 and the shield body 138 (shown in FIG. 1) of the header assembly 104 (shown in FIG. 1). For example, the conductive gasket 202 may engage, and be electrically connected to the holders 120 and the holders 140 (shown in FIG. 1) to electrically common the holders 120 to the holders 140. In an exemplary embodiment, the shield body 118 has a plurality of exposed surfaces 206 at the mating end 128. The conductive gasket 202 engages the exposed surfaces 206 to electrically common the conductive gasket 202 and the shield body 118.

The receptacle assembly 102 includes a retainer 208 coupled to each of the holders 120 and end holders 132, 134. The retainer 208 secures together each of the holders 120 and end holders 132, 134. Optionally, the holders 120 and end holders 132, 134 may be coupled directly to one another, such as using alignment or securing features integrated into the holders 120 and end holders 132, 134. Once held together, the holders 120 and end holders 132, 134 form the shield body 118 which structurally supports the contact modules 122 and electrically shields the receptacle contacts 124.

The receptacle contacts 124 include mating portions 212 that extend forward for mating with the header contacts 144 (shown in FIG. 1). The mating portions 212 are configured to be loaded into the mating housing 126. The receptacle contacts 124 include mounting portions defined by contact tails 214 extending downward for mounting to the circuit board 106. The contact tails 214 may be compliant pins, such as eye-of-the-needle contacts, that may be press fit into plated vias in the circuit board 106.

The conductive gasket 202 includes a first surface 220 that is configured to engage the mating end 128 of the shield body 118. The conductive gasket 202 includes a second surface 222 opposite the first surface 220 that engages the shield body 138 of the header assembly 104. The conductive gasket 202 may be fabricated from a compressible material that is compressed when the header assembly 104 is mated with the receptacle assembly 102. For example, the conductive gasket 202 may be an elastomeric sheet that is compressible to define a compressible interface between the shield body 118 and the shield body 138. The elastomeric sheet is conductive to define a conductive pathway between the first and second surfaces 220, 222. The edges of the shield body 118, 138 engage the conductive gasket 202, eliminating electrical stubs by conductive elements, such as spring beams, sliding along the surfaces of the shield bodies 118, 138 to make electrical connection therebetween. The conductive gasket 202 may be fabricated from a compliant plastic or rubber material having conductive filler, a conductive plating, a conductive coating and the like. Alternatively, the conductive gasket 202 may be fabricated from a conductive fabric, such as a woven mesh. In other alternative embodiments, the conductive gasket 202 may be fabricated from a metallic plate, metallic strips, or a metallic mold or die. In such embodiments, the conductive gasket 202 may include compressible elements such as spring fingers to ensure contact between the conductive gasket 202 and the shield bodies 118 and/or 138.

The conductive gasket 202 includes a plurality of openings 224. The mating portions 212 of the receptacle contacts 124 extend from the contact modules 122 through respective openings 224. In an exemplary embodiment, a pair of mating portions 212 is provided within each opening 224. The pairs of mating portions 212 correspond to differential pairs 129 (shown in FIG. 1) made up of the receptacle contacts 124. As such, each differential pair 129 is surrounded by the conductive gasket 202 at the separable interface between the receptacle and header assemblies 102, 104.

The conductive gasket 202 includes a plurality of longitudinal strips 230 and a plurality of lateral strips 232 that intersect with the longitudinal strips 230 to form a lattice 234. In an exemplary embodiment, the longitudinal strips 230 and lateral strips 232 are integrally formed with one another. The longitudinal strips 230 and lateral strips 232 cooperate to define the openings 224. For example, each opening 224 is bounded by two longitudinal strips 230 and two lateral strips 232. The layout and footprint of the lattice 234 is sized and shaped similar to the size and shape of the mating housing 126 such that the conductive gasket 202 can be fit over the mating housing 126. As such, when the conductive gasket 202 is mounted to the receptacle assembly 102, the longitudinal strips 230 and lateral strips 232 are aligned with, and engage, the exposed surfaces 206 of the shield body 118 to make electrical contact with the shield body 118.

The conductive gasket 202 includes an outer perimeter 236. The outermost longitudinal strips 230 and the outermost lateral strips 232 define the outer perimeter 236. In the illustrated embodiment, the outer perimeter 236 has a rectangular shape, however other shapes are possible in alternative embodiments. Each of the openings 224 is contained within the outer perimeter 236.

When assembled, the conductive gasket 202 defines a ground path between the receptacle and header assemblies 102, 104. As such, the shield body 118 is electrically grounded to the shield body 138 through the conductive gasket 202. The conductive gasket 202 allows the receptacle assembly 102 to be electrically grounded to the header assembly 104 without using typical electrically conductive individual ground contacts or ground pins of the assemblies that are mated together. As such, the total number of contacts that are mated is reduced by limiting the contacts to signal contacts as opposed to signal and ground contacts. Additionally, 360° of shielding is provided by the gasket 202 around the mating portions 212.

The mating housing 126 includes a base 238 that is configured to be mounted to the front of the holders 120 and contact modules 122. The base 238 includes a plurality of openings 240 therethrough. The openings 240 are aligned with the shield body 118 and the exposed surfaces 206 of the shield body 118 extend through the openings 240.

The mating housing 126 includes a plurality of silos 242 extending forward from the base 238. The openings 240 are positioned between the silos 242. The mating housing 126 includes a plurality of contact channels 244 extending through the silos 242 and the base 238. The contact channels 244 receive the mating portions 212 of the receptacle contacts 124 to provide support for the receptacle contacts 124. In an exemplary embodiment, each silo 242 includes two contact channels 244 that receive receptacle contacts 124 of one of the differential pairs 129 made up of receptacle contacts 124.

The silos 242 are separated from one another by a horizontal space 246 and a vertical space 248. The conductive gasket 202 is configured to be mounted to the receptacle assembly 102 over the mating housing 126. The lattice 234 fits into the horizontal and vertical spaces 246, 248. For example, the longitudinal strips 230 fit into the horizontal spaces 246 and the lateral strips 232 fit in the vertical spaces 248. The longitudinal strips 230 and the lateral strips 232 are configured to be loaded into the horizontal and vertical spaces 246, 248 until the conductive gasket 202 engages the shield body 118 extending through the mating housing 126. The horizontal and vertical spaces 246, 248 are configured to receive the walls 432 (shown in FIG. 1) and/or the strips 434 (shown in FIG. 1) of the holder 140 (shown in FIG. 1) therein to provide shielding between the silos 242. The walls 432 and strips 434 of the holders 140 are loaded into the horizontal and vertical spaces 246, 248 until the walls 432 and strips 434 of the holders 140 engage the conductive gasket 202.

Figure 3:
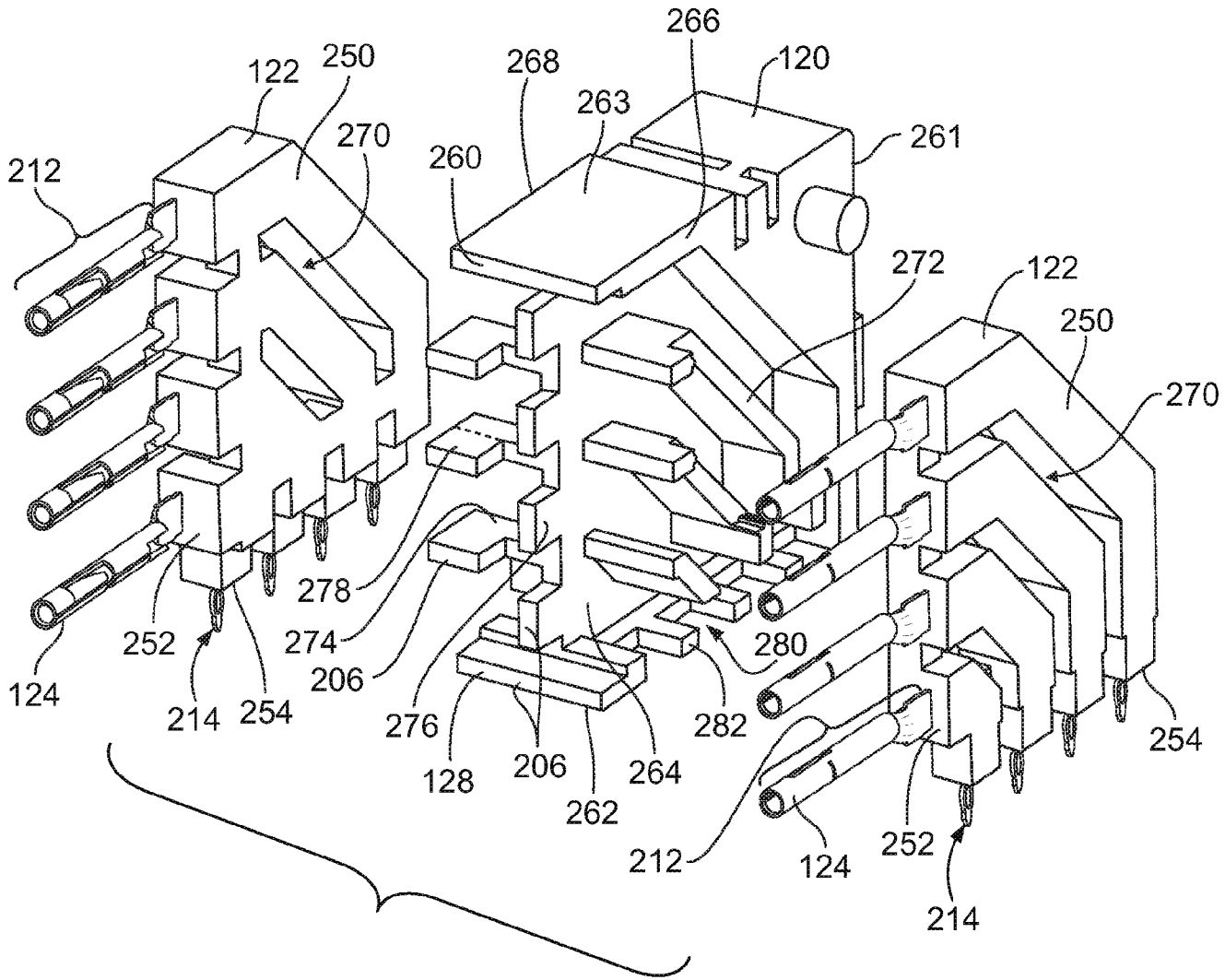
FIG. 3 is an exploded front perspective view of a portion of the receptacle assembly showing a plurality of contact modules posed for loading into a holder.

FIG. 3 is an exploded front perspective view of a portion of the receptacle assembly 102 showing a plurality of contact modules 122 poised for loading into one of the holders 120. The holder 120 includes a body configured to support a plurality of the contact modules 122. The body defines a portion of the shield body 118 (shown in FIG. 1). The holder 120 includes a front 260 and a rear 261. The holder 120 includes a bottom 262 and a top 263. In the illustrated embodiment, each holder 120 supports two contact modules 122. More or less contact modules 122 may be supported by a particular holder 120 in alternative embodiments.

In an exemplary embodiment, the holder 120 is fabricated from a conductive material. For example, the holder 120 may be die-cast from a metal material. Alternatively, the holder 120 may be stamped and formed or may be fabricated from a plastic material that has been metalized or coated with a metallic layer. By having the holder 120 fabricated from a conductive material, the holder 120 may define a ground shield for the receptacle assembly 102. A separate ground shield does not need to be provided and coupled to the contact modules 122 prior to assembling together the contact modules 122. Rather, the holder 120 defines the ground shield and also supports the contact modules 122 as part of the shield body 118. When the holders 120 are ganged together, the holders 120 define the shield body 118 of the receptacle assembly 102. The holders 120 may be ganged together by coupling the individual holders 120 to one another or by using a separate component, such as the retainer 208 (shown in FIG. 2). The holders 120 are ganged together such that the contact modules 122 are stacked parallel to one another. Portions of the holders 120 may extend between respective contact modules 122 to provide electrical shielding therebetween.

The holder 120 provides electrical shielding between and around respective contact modules 122. The holder 120 provides shielding from electromagnetic interference (EMI) and/or radio frequency interference (RFI). The holder 120 may provide shielding from other types of interference as well. The holder 120 provides shielding around the contact modules 122 and/or between the receptacle contacts 124 or differential pairs 129, of the contact modules 122 to control electrical characteristics, such as impedance control, crosstalk control, and the like, of the receptacle contacts 124. For example, by having the holder 120 electrically grounded, the holder 120 provides shielding for the contact modules 122 to control the electrical characteristics.

In the illustrated embodiment, the holder 120 provides shielding along the top, back, and bottom of the contact modules 122. Optionally, the holder 120 may provide shielding between any or all of the contact modules 122 and/or between any or all of the receptacle contacts 124. For example, as in the illustrated embodiment, each holder 120 includes a support wall 264. The support wall 264 is provided between the pair of contact modules 122 held by the holder 120. The support wall 264 provides shielding between the contact modules 122 held by the holder 120. Optionally, the support wall 264 may be substantially centrally located between opposite sides 266, 268 of the holder 120. The contact modules 122 are loaded into the holder 120 such that the contact modules 122 abut against the support wall 264.

Each contact module 122 includes a dielectric frame 250 surrounding the receptacle contacts 124. The frame 250 of the contact module 122 includes a mating end 252 and a mounting end 254. In an exemplary embodiment, the receptacle contacts 124 are initially held together as a lead frame, which is overmolded with a dielectric material to form the dielectric frame 250. After the lead frame is overmolded, the receptacle contacts 124 are separated from one another. Other manufacturing processes may be utilized to form the contact modules 122 other than overmolding a lead frame, such as loading receptacle contacts 124 into a formed dielectric body.

Each of the receptacle contacts 124 includes one of the contact tails 214 at one end thereof, and one of the mating portions 212 at an opposite end thereof. The mating portions 212 and contact tails 214 are the portions of the receptacle contacts 124 that extend from the dielectric frame 250. The mating portions 212 extend from the mating end 252 and the contact tails 214 extend from the mounting end 254. In an exemplary embodiment, the mating portions 212 extend generally perpendicular with respect to the contact tails 214. Inner portions or encased portions of the receptacle contacts 124 transition between the mating portions 212 and the contact tails 214 within the dielectric frame 250.

The dielectric frame 250 includes a plurality of windows 270 extending through the dielectric frame 250. The windows 270 are internal of the dielectric frame 250 and located between adjacent receptacle contacts 124. The windows 270 are elongated and generally follow the paths of the receptacle contacts 124 between the contact tails 214 and the mating portions 212.

The holder 120 includes tabs 272, 274 that extend into the windows 270 when the contact modules 122 are coupled to the holder 120 and when the holders 120 are coupled together. The tabs 272, 274 support the contact modules 122 within the corresponding holder 120. The tabs 272, 274 provide shielding between the adjacent receptacle contacts 124.

The holder 120 includes fingers 276 extending from a front of the support wall 264. Edges of the fingers 276 define the exposed surfaces 206 of the holder 120 and thus the interface of the shield body 118 to the interface of the gasket 202. The fingers 276 provide a surface for interfacing with the conductive gasket 202. The fingers 276 are oriented vertically. The edges of the fingers 276 may be coplanar with the front 260 of the holder 120. In the illustrated embodiment, the fingers 276 are aligned with the mating portions 212 of the receptacle contacts 124. The fingers 276 are positioned between the mating portions 212 of the receptacle contacts 124 and provide shielding between the mating portions 212. In an exemplary embodiment, the fingers 276 are located horizontally adjacent corresponding receptacle contacts 124 such that the fingers 276 are directly between adjacent receptacle contacts 124 within a particular row.

The holder 120 includes fingers 278 that are offset from the fingers 276. In the illustrated embodiment, the fingers 278 extend forward from corresponding tabs 274, however the fingers 278 may extend directly from the support wall 264 or another portion of the holder 120 in an alternative embodiment. Edges of the fingers 278 define the exposed surfaces 206 of the holder 120 and thus the interface of the shield body 118 to the interface of the gasket 202. The fingers 278 provide a surface for interfacing with the conductive gasket 202. The fingers 278 are oriented horizontally. The edges of the fingers 276 may be coplanar with the front 260 of the holder 120. In the illustrated embodiment, the fingers 278 are aligned with the mating portions 212 of the receptacle contacts 124. The fingers 278 are positioned between the mating portions 212 of the receptacle contacts 124 and provide shielding between the mating portions 212. In an exemplary embodiment, the fingers 278 are located vertically adjacent corresponding receptacle contacts 124 such that the fingers 278 are directly between adjacent receptacle contacts 124 within a particular column.

The bottom 262 of the holder 120 includes a plurality of openings 280. Fingers 282 are provided between each of the openings 280. The fingers 282 may form part of the tabs 272, 274, or alternatively, may be separate from the tabs 272, 274. Portions of the contact modules 122 are configured to be received in the openings 280 when the contact modules 122 are loaded into the holder 120. The fingers 282 are positioned between such portions of the contact modules 122 to provide electrical shielding between the receptacle contacts 124. The bottom 262 of the holder 120 is exposed and provides a surface for interfacing with the conductive gasket 200. The fingers 282 define part of the bottom 262 and are exposed for interfacing with the conductive gasket 200.

Figure 4:
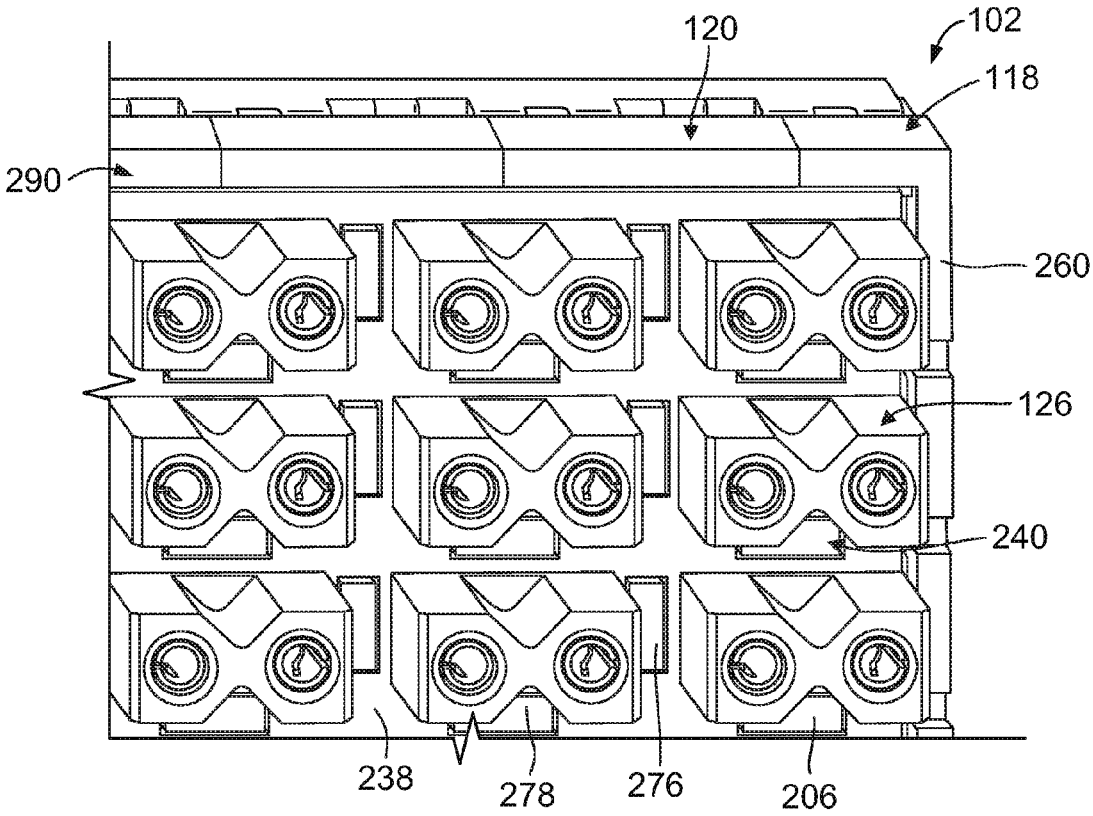
FIG. 4 is a front perspective view of a portion of the receptacle assembly.

FIG. 4 is a front perspective view of a portion of the receptacle assembly 102. The mating housing 126 is coupled to the shield body 118. The openings 240 are aligned with the shield body 118 such that the fingers 276, 278 extend through corresponding openings 240. The exposed surfaces 206 defined by the edges of the fingers 276, 278 extend through the openings 240. Optionally, the exposed surfaces 206 may be substantially flush or even slightly projecting from the base 238. The fronts 260 of the holders 120 define an outer perimeter 290 that surrounds the mating housing 126. The front 260 also defines exposed surfaces 206 that are configured to engage the conductive gasket 202 (shown in FIG. 2) when the conductive gasket 202 is positioned between the receptacle assembly 102 and the header assembly 104 (shown in FIG. 1).

Figure 5:
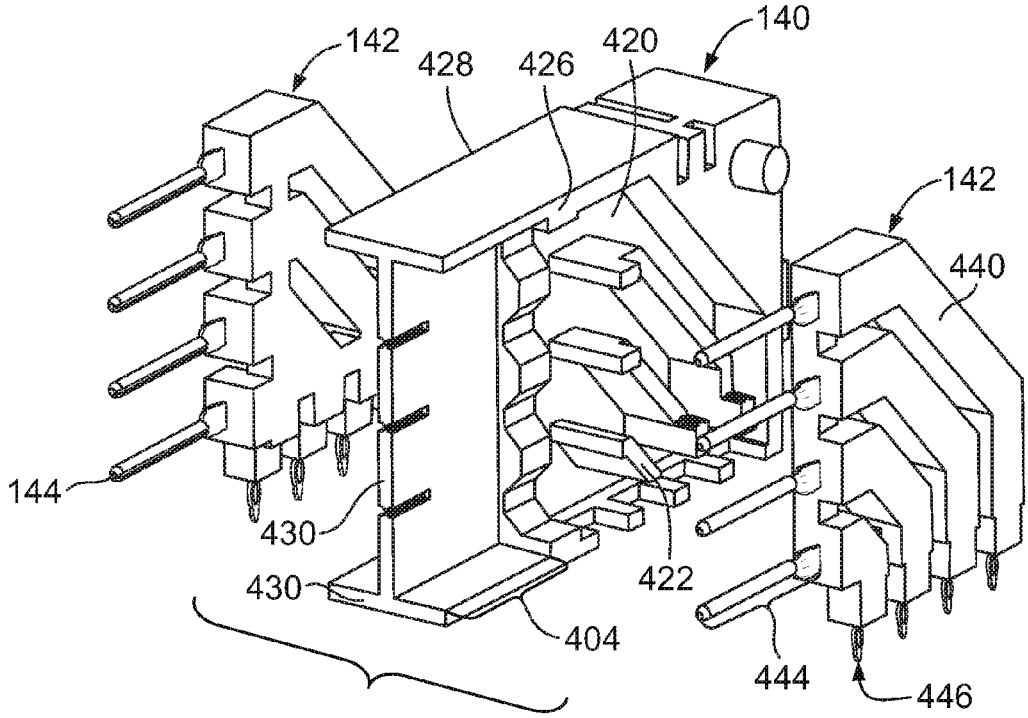
FIG. 5 is an exploded view of a portion of the header assembly showing a holder and contact modules for the header assembly.

FIG. 5 is an exploded view of the holder 140 and contact modules 142 for the header assembly 104 (shown in FIG. 1). The holder 140 is similar to the holder 120 (shown in FIG. 3) and includes similar features. Unlike the holder 120, the holder 140 has a front extension 404 that defines the loading chamber 156 (shown in FIG. 1). The contact modules 142 are similar to the contact modules 122 (shown in FIG. 3) and include similar features, however the contact modules 142 hold the header contacts 144, which are different than the receptacle contacts 124 (shown in FIG. 3).

The holder 140 includes a support wall 420. The support wall 420 provides shielding between the contact modules 142. The holder 140 includes tabs 422 that extend from opposite sides of the support wall 424. The tabs 422 may be similar to the tabs 272, 274 (shown in FIGS. 3 and 4). The tabs 422 generally extend to sides 426, 428, respectively, of the holder 140. The support wall 420 extends to the front of the holder 140. In the illustrated embodiment, the holder 140 has a generally I-shaped cross-section at the front. The front of the holder 140 includes one or more exposed surfaces 430 that are configured to engage the conductive gasket 202 (shown in FIG. 1) when the conductive gasket 202 is assembled to the receptacle assembly 102. Optionally, the entire front edge of the holder 140, which forms the wall 432, may define the exposed surface 430. The horizontal strips 434 may also define exposed surfaces 430. The conductive gasket 202 may be held on the receptacle assembly 102 using conductive adhesive, conductive epoxy or features of the receptacle assembly 102 that hold the conductive gasket 202 in place, such as by an interference fit.

Each contact module 142 includes a dielectric frame 440 surrounding the header contacts 144. Each of the header contacts 144 includes a mating portion 444 at one end thereof and a contact tail 446 at an opposite end thereof. The mating portions 444 constitute pin contacts having a generally cylindrical shape that is configured to be received within the barrel portions of the receptacle contact 124. The contact tails 446 constitute press-fit pins, such as eye-of-the-needle contacts that are configured to be received in plated vias in the circuit board 108 (shown in FIG. 1).

Figure 6:
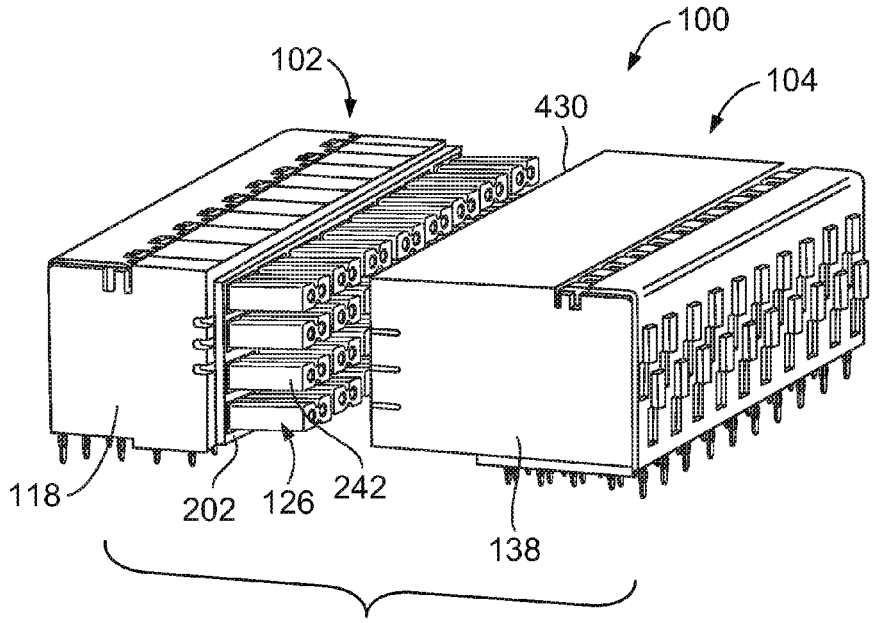
FIG. 6 is a side view of the connector system illustrating the receptacle assembly and header assembly being mated together.

FIG. 6 is a side view of the connector system 100 illustrating the receptacle assembly 102 and header assembly 104 being mated together. The conductive gasket 202 is coupled to the receptacle assembly 102 along the front of the shield body 118. The mating housing 126 extends beyond the conductive gasket 202. The strips 230, 232 (shown in FIG. 2) are positioned between the silos 242. The conductive gasket 202 engages the exposed surfaces 206 (shown in FIG. 4) to make electrical contact with the shield body 118.

During assembly, the header assembly 104 is coupled to the receptacle assembly 102 such that the shield body 138 engages the conductive gasket 202. The exposed surfaces 430, such as the walls 432 and the strips 434, engage the conductive gasket 202 to make electrical contact between the conductive gasket 202 and the shield body 138. Optionally, the conductive gasket 202 may be at least partially compressed when the header assembly 104 is coupled to the receptacle assembly 102. The conductive path passes straight through the conductive gasket 202 between the edges of the header and receptacle assemblies 104, 102. This type of connection removes and/or eliminates electrical stub and improves electrical performance.

Figure 7:
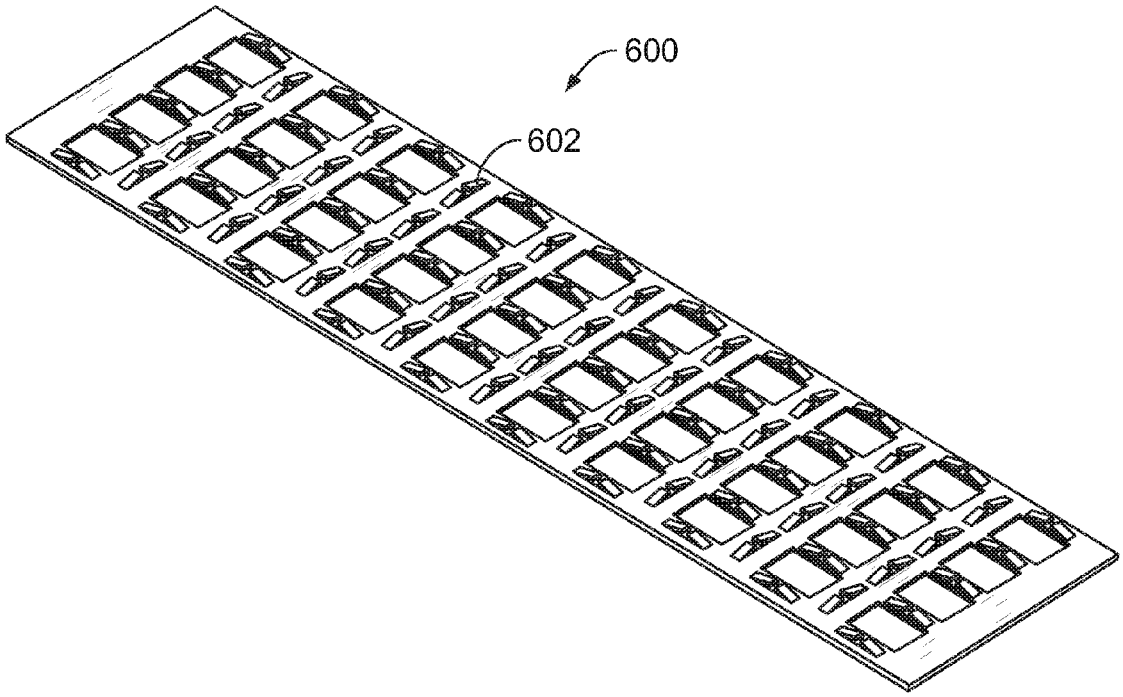
FIG. 7 illustrates an alternative conductive gasket for placement between the header assembly and the receptacle assembly.

FIG. 7 illustrates an alternative conductive gasket 600 for placement between the header assembly 104 (shown in FIG. 1) and the receptacle assembly 102 (shown in FIG. 1) and/or for placement between the header assembly 104 or the receptacle assembly 102 and the corresponding circuit boards 108, 106.

The conductive gasket 600 is stamped and formed. The conductive gasket 600 includes a plurality of spring fingers 602 that are bent out of plane with respect to the conductive gasket 600. The spring fingers 602 are configured to engage the header assembly 104 (or the receptacle assembly 102). Optionally, at least some of the spring fingers 602 may be bent upward and some of the spring fingers 602 may be bent downward to engage both the header assembly 104 and the receptacle assembly 102. Any number of spring fingers 602 may be provided. Having multiple spring fingers 602 creates multiple points of contact to the header assembly 104 and/or the receptacle assembly 102.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

contact modules having dielectric bodies holding contacts, the contacts having mating portions extending from the dielectric body configured to be mated to corresponding mating contacts of a mating connector assembly;

a conductive shield body holding the contact modules in a stacked configuration, the shield body providing shielding around the contact modules, the shield body having a mating end configured to be mated to the mating connector assembly, the mating end having one or more exposed surfaces between corresponding contacts, the shield body extending between selected contact modules; and a conductive gasket positioned along the mating end of the shield body, the conductive gasket engaging the exposed surfaces of the shield body to define a ground path between the conductive shield body and the mating connector assembly.

2. The connector assembly of claim 1, wherein the conductive gasket includes longitudinal strips and lateral strips arranged in a lattice having openings, the mating portions of the contacts extending through the openings, the mating portions of the contacts being spaced apart from the longitudinal strips and lateral strips.

3. The connector assembly of claim 1, wherein the conductive gasket is planar having a first surface engaging the exposed surfaces of the shield body and a second surface configured to engage a shield body of the mating connector assembly, the second surface defining a forward-most shield surface of the connector assembly, the mating portions of the contacts extending forward beyond the second surface for mating with the mating contacts of the mating connector assembly.

4. The connector assembly of claim 1, further comprising a mating housing coupled to the mating end of the shield body, the mating housing having a dielectric body having a plurality of silos having contact channels receiving corresponding mating portions of the contacts, the silos being spaced apart from one another, the mating housing having openings therethrough, wherein the exposed surfaces extend through the openings, the conductive gasket having strips defining openings therethrough, the conductive gasket being coupled to the mating housing such that the strips fit between the silos and the silos extend through the openings in the conductive gasket.

5. The connector assembly of claim 1, wherein the conductive gasket is a conductive elastomeric sheet having openings, the openings receiving the mating portions of the contacts.

6. The connector assembly of claim 1, wherein the conductive gasket is metal plate having a plurality of openings, the openings receiving the mating portions of the contacts, the metal plate having spring fingers extending therefrom configured to engage at least one of the mating connector assembly or the exposed surfaces of the shield body.

7. The connector assembly of claim 1, wherein the mating portions of the contacts are arranged in a matrix within an outer perimeter of the mating end of the shield body, the conductive gasket extending along the outer perimeter of the mating end.

8. The connector assembly of claim 1, wherein the contacts are arranged in differential pairs, the conductive gasket being positioned between each adjacent differential pair of mating portions of the contacts.

9. The connector assembly of claim 1, wherein the shield body is conductive and is positioned between selected contacts to provide electrical shielding therebetween.

10. The connector assembly of claim 1, wherein the conductive gasket is compressive, the conductive gasket being configured to be compressed between the mating end of the shield body and a shield body of the mating connector assembly.

11. A connector assembly comprising:

contact modules each having a dielectric body, the dielectric body having a mating end and a mounting end, the contact modules having contacts held by the dielectric body, the contacts having contact tails and mating portions opposite the contact tails, the contact tails extending from the mounting end of the dielectric body, the contact tails configured to be mounted to a circuit board, the mating portions extending from the mating end of the dielectric body and being configured to be mated to corresponding mating contacts of a mating connector assembly;

a conductive shield body holding the contact modules in a stacked configuration, the shield body providing shielding around the contact modules, the shield body extending between selected contact modules to provide shielding between such contact modules, the shield body having a mating end configured to be mated to the mating connector assembly, the mating end having one or more exposed surfaces between corresponding contacts; and a conductive gasket positioned along the mating end of the shield body, the conductive gasket engaging the exposed surfaces of the shield body and being configured to define a ground path between the conductive shield body and the mating connector assembly.

12. The connector assembly of claim 11, wherein the contact modules are arranged in contact module sets with two contact modules in the contact module sets, the shield body extending between, and providing electrical shielding between, adjacent contact module sets.

13. The connector assembly of claim 11, wherein the contact modules are held in the shield body with the contacts arranged in differential pairs, the shield body providing electrical shielding between each of the differential pairs.

14. The connector assembly of claim 11, further comprising a mating housing coupled to the mating end of the shield body, the mating housing having a dielectric body having a plurality of silos having contact channels receiving corresponding mating portions of the contacts, the silos being spaced apart from one another, the mating housing having openings therethrough, wherein the exposed surfaces extend through the openings, the conductive gasket having strips defining openings therethrough, the conductive gasket being coupled to the mating housing such that the strips fit between the silos and the silos extend through the openings in the conductive gasket.

15. The connector assembly of claim 11, wherein the conductive gasket is planar having a first surface engaging the exposed surfaces of the shield body and a second surface configured to engage a shield body of the mating connector assembly, the second surface defining a forward-most shield surface of the connector assembly, the mating portions of the contacts extending forward beyond the second surface for mating with the mating contacts of the mating connector assembly.

16. The connector assembly of claim 11, wherein the shield body comprises a plurality of individual holders coupled together, each holder having a support wall, each holder holding one of the contact modules on one side of the support wall and another of the contact modules on another side of the support wall, the support wall providing shielding between the contact modules, the support wall having fingers extending therefrom with edges of the fingers defining the exposed surfaces.

17. A connector system comprising:

a header assembly comprising header holders and header contact modules supported by the header holders, the header holders having mating ends and support walls extending from the mating ends, the header contact modules having dielectric frames and header contacts held by the dielectric frames, the header contacts having mating portions extending from the dielectric frames, the header holders being coupled together such that the contact modules are stacked together with support walls providing shielding between header contact modules on opposite sides of the support walls;

a receptacle assembly comprising receptacle holders and receptacle contact modules supported by the receptacle holders, the receptacle holders having mating ends and support walls extending from the mating ends, the receptacle contact modules having dielectric frames and receptacle contacts held by the dielectric frames, the receptacle contacts having mating portions extending from the dielectric frames mated with corresponding mating portions of the header contact modules, the receptacle holders being coupled together such that the contact modules are stacked together with support walls providing shielding between receptacle contact modules on opposite sides of the support walls; and a conductive gasket positioned between the mating ends of the header holders and the receptacle holders, the conductive gasket engaging exposed surfaces of the header holders and the receptacle holders to define a ground path therebetween.

18. The connector system of claim 17, further comprising a mating housing coupled to the mating ends of the receptacle holders, the mating housing having a dielectric body having a plurality of silos having contact channels receiving corresponding mating portions of the receptacle contacts, the silos being spaced apart from one another, the mating housing having openings therethrough, wherein the exposed surfaces of the header holders extend through the openings, the conductive gasket having strips defining openings therethrough, the conductive gasket being coupled to the mating housing such that the strips fit between the silos and the silos extend through the openings in the conductive gasket, the header assembly and receptacle assembly being coupled together such that the support walls of the header holders fit between the silos and engage the conductive gasket.

19. The connector system of claim 17, wherein the conductive gasket is planar having a first surface engaging the exposed surfaces of the receptacle holders and a second surface engaging the exposed surfaces of the header holders.

20. The connector system of claim 17, wherein the conductive gasket includes longitudinal strips and lateral strips arranged in a lattice having openings, the mating portions of the receptacle contacts extending through the openings.

* * * * *